US006489277B1

(12) United States Patent
Michaud

(10) Patent No.: US 6,489,277 B1
(45) Date of Patent: Dec. 3, 2002

(54) QUASI-AZEOTROPIC MIXTURE BASED ON 1,1,1,3,3-PENTAFLUOROBUTANE, METHYLENE CHLORIDE AND METHANOL FOR THE TREATMENT OF SOLID SURFACES

(75) Inventor: Pascal Michaud, Saint-Gratien (FR)

(73) Assignee: Elf Atochem S.A., Puteaux (FR)

( * ) Notice: Subject to any disclaimer, the term of this patent is extended or adjusted under 35 U.S.C. 154(b) by 0 days.

(21) Appl. No.: 09/670,120

(22) Filed: Sep. 26, 2000

Related U.S. Application Data

(63) Continuation of application No. 09/126,104, filed on Jul. 30, 1998, now abandoned.

(30) Foreign Application Priority Data

Jul. 31, 1997 (FR) ..... 97 09775

(51) Int. Cl.[7] ..... C11D 7/30

(52) U.S. Cl. ..... 510/175; 570/177; 570/408; 570/410; 570/411; 570/412; 570/415

(58) Field of Search ..... 510/412, 410, 510/408, 411, 175, 176, 273, 365, 177; 252/194, 364

(56) References Cited

U.S. PATENT DOCUMENTS

| | | | | |
|---|---|---|---|---|
| 5,268,121 A | | 12/1993 | Michaud | 252/172 |
| 5,348,681 A | | 9/1994 | Desbiendras et al. | 252/172 |
| 5,350,534 A | * | 9/1994 | Michaud | 252/171 |
| 5,445,757 A | | 8/1995 | Pennetreau | 252/171 |
| 5,714,298 A | | 2/1998 | Barthelemy et al. | 430/124 |

FOREIGN PATENT DOCUMENTS

| | | | |
|---|---|---|---|
| EP | 189436 | | 10/1999 |
| FR | 2353625 | | 12/1977 |
| FR | 90677 | | 10/1983 |
| FR | 2527625 | | 12/1983 |
| JP | 5-168805 | * | 7/1993 |
| JP | 5-171190 | * | 9/1993 |

OTHER PUBLICATIONS

John A. Monick, Research Associate: Colgate–Palmolive Research Center, "Alcohols Their Chemistry, Properties and Manufacture", Reinhold Book Corporation, copyright 1968, pp. 88–111.

* cited by examiner

*Primary Examiner*—Necholus Ogden
(74) *Attorney, Agent, or Firm*—Smith, Gambrell & Russell, LLP

(57) ABSTRACT

In order to replace 1,1,2-trichloro-1,2,2-trifluoroethane and 1,1-dichloro-1-fluoroethane in compositions for treating solid surfaces (in particular defluxing), the invention proposes the use of a quasi-azeotropic mixture containing, by weight, from 75 to 95% of 1,1,1,3,3-pentafluorobutane, from 1 to 15% of methylene chloride and from 1 to 10% of methanol.

8 Claims, No Drawings

QUASI-AZEOTROPIC MIXTURE BASED ON 1,1,1,3,3-PENTAFLUOROBUTANE, METHYLENE CHLORIDE AND METHANOL FOR THE TREATMENT OF SOLID SURFACES

An This application is a continuation under 53(b) of application Ser. No. 09/126,104, filed on Jul. 30, 1998 now abandoned. This related application is relied on and incorporated herein by reference in its entirety.

The present invention concerns the field of fluorinated hydrocarbons, and relates more particularly to a novel quasi-azeotropic mixture which can be used in various operations for treating solid surfaces, in particular for drying, cleaning, degreasing or dry-cleaning solid surfaces.

BACKGROUND OF THE INVENTION 1,1,2-Trichloro-1,2,2-trifluoroethane (known in the trade by the name F113) has been used widely in industry for cleaning and degreasing a variety of solid surfaces (metal, glass, plastic and composite parts). Further to its application in electronics for cleaning soldering fluxes in order to remove the flux sticking to printed circuits, mention may be made of its applications for degreasing large metal parts and cleaning high-quality, high-precision mechanical parts such as, for example, gyroscopes and military, aerospace or medical equipment. In its various applications, F113 has most often been combined with other organic solvents (for example methanol), preferably in the form of azeotropic or quasi-azeotropic mixtures which do not demix and which, when used in reflux, have substantially the same composition in the vapour phase as in the liquid phase.

F113 has also been used in industry for drying or dewetting various solid substrates after they have been cleaned in an aqueous medium. In this application, intended to remove the water remaining on the surface of the substrates which have been cleaned, F113 was often supplemented by one or more surfactants (see for example Patents FR 2 353 625, FR 2 527 625, EP 90677 and 189 436, as well as the references cited in these patents).

Since F113 belongs to the chlorofluorocarbons (CFCs) suspected of attacking or degrading stratospheric ozone, it has been proposed to replace it in these various applications by 1,1-dichloro-1-fluoroethane (known under the name F141b).

Although the ozone depletion potential (ODP) of F141b is much less than that of F113, it is nevertheless not zero, and the use of this substance has already been regulated.

In order to solve this problem, it has been proposed in U.S. Pat. No. 5 350 534 to replace F113 or F141b by an azeotropic mixture consisting, by weight, of from 30 to 69% of 1,1,1,3,3-pentafluorobutane (F365 mfc), from 30 to 60% of methylene chloride and from 1 to 10% of methanol. However, the high methylene chloride content of this mixture (30% minimum) makes it unusable for treating solid surfaces consisting entirely or partially of fragile plastics, because its use causes crazing or cracks on these materials and/or makes them tacky.

DESCRIPTION OF THE INVENTION

It has now been found that this drawback can be overcome, and essentially all the advantages of the azeotropic mixture mentioned above can be retained by using a mixture containing, by weight, no more than 15% of methylene chloride, the remainder consisting of from 75 to 95% purely of F365 mfc and from 1 to 10% of methanol, the minimum methylene chloride content being 1%.

This mixture allows unproblematic cleaning of sensitive materials such as acrylonitrile-butadiene-styrene copolymers (ABS), polycarbonates (PC) and polymethyl methacrylates (PMMA). Furthermore, this mixture does not exhibit a flashpoint under standard determination conditions (ASTM Standard D 3828) and therefore makes it possible to work in full safety.

A more particularly preferred mixture according to the invention contains, by weight, from 85 to 90% of F365 mfc, from 5 to 10% of methylene chloride and from 2 to 5% of methanol.

As in the known compositions based on F113 or F141b, the mixtures according to the invention may, if so desired, be stabilized against the hydrolysis and/or the radical attacks which may take place during cleaning processes. To this end, they are supplemented by a customary stabilizer such as, for example, a nitroalkane, an acetal or an epoxide, it being possible for the proportion of stabilizer to range from 0.01 to 5% relative to the total weight of the mixture.

The mixtures according to the invention can be used under the same conditions and according to the same techniques as the prior compositions based on F113 or F141b.

The mixtures according to the invention dissolve silicone products, in particular silicone greases. They can therefore be used to clean parts which have silicone derivatives on the surface or to deposit derivatives of this type on these parts, for example by soaking these parts in a solution of silicone in a mixture according to the invention.

The mixtures according to the invention are non-flammable and evaporate quickly. They can therefore be used, in full safety, in high-speed laser printers.

EXAMPLES

The following examples illustrate the invention without limiting it.

Example 1

150 g of a mixture containing, by weight, 89% of F365 mfc, 3.5% of methanol, 7% of methylene chloride and 0.5% of nitromethane (stabilizer) were introduced into an ultrasonic cleaning vessel.

After the system had been refluxed for one hour, an aliquot of the vapour phase was sampled. Analysis of this, by gas chromatography (see table below), showed that the composition of the mixture is virtually unchanged and that it is stabilized in the vapour phase.

| | Composition (% by weight) | | | |
|---|---|---|---|---|
| | F365 mfc | $CH_2Cl_2$ | Methanol | $CH_3NO_2$ |
| Initial mixture | 89 | 7 | 3.5 | 0.5 |
| Sampled fraction | 88.8 | 6.9 | 4 | 0.3 |

Example 2

Five test circuits (IPC-B-25 standardized model) were coated with colophane-based flux (flux R8F from the company ALPHAMETAL) and stoved at 220° C. for 30 seconds.

These circuits were cleaned using the quasi-azeotropic mixture in Example 1, in a small ultrasound machine for 3 minutes by immersion and 3 minutes in vapour phase.

The cleaning was evaluated according to the IPC 2.3.26 standardized procedure with the aid of a precision conductimeter. The value obtained, 2.2 pg/cm$^2$ eq. NaCl, is less than the professionally tolerated ion impurity threshold (2.5 $\mu$g/cm$^2$ eq. NaCl)

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

What is claimed is:

1. A quasi-azeotropic mixture consisting essentially of, by weight, from 75 to 95% of 1,1,1,3,3-pentafluorobutane, from 1 to 15% of methylene chloride, and from 1 to 10% of methanol.

2. The mixture according to claim 1, wherein the mixture consists essentially of:

85 to 90% of 1,1,1,3,3-pentafluorobutane, from 5 to 10% of methylene chloride, and from 2 to 5% of methanol.

3. The mixture according to claim 1, wherein the mixture further includes at least one stabilizer.

4. The mixture according to claim 3, wherein the stabilizer is from 0.01 to 5% relative to the total weight of the mixture.

5. A method of treating a solid surface, comprising applying the mixture according to claim 1 to said solid surface.

6. A method for drying or de-wetting a wet, solid surface, comprising applying the mixture according to claim 1 to the wet, solid surface.

7. The method according to claim 5, wherein the solid surface comprises a printed surface to be fluxed.

8. The method according to claim 5, wherein the solid surface is a mechanical part to be degreased.

* * * * *